US009353494B2

(12) United States Patent
Arntz et al.

(10) Patent No.: US 9,353,494 B2
(45) Date of Patent: May 31, 2016

(54) SNOW REMOVAL DEVICE

(71) Applicant: Technische Universiteit Eindhoven, Eindhoven (NL)

(72) Inventors: Hendrikus Petrus Maria Arntz, Eindhoven (NL); Theodorus Petrus Maria Arntz, Nijmegen (NL)

(73) Assignee: Technische Universiteit Eindhoven, Eindhoven (NL)

( * ) Notice: Subject to any disclaimer, the term of this patent is extended or adjusted under 35 U.S.C. 154(b) by 0 days.

(21) Appl. No.: 14/830,677

(22) Filed: Aug. 19, 2015

(65) Prior Publication Data

US 2015/0354158 A1 Dec. 10, 2015

Related U.S. Application Data

(63) Continuation-in-part of application No. 14/391,167, filed as application No. PCT/EP2013/057325 on Apr. 8, 2013, now Pat. No. 9,303,376.

(60) Provisional application No. 62/047,952, filed on Sep. 9, 2014, provisional application No. 62/114,144, filed on Feb. 10, 2015, provisional application No. 61/623,918, filed on Apr. 13, 2012.

(51) Int. Cl.

| | |
|---|---|
| ***E01H 5/00*** | (2006.01) |
| ***E01H 5/04*** | (2006.01) |
| ***E01H 5/09*** | (2006.01) |
| ***E01H 5/12*** | (2006.01) |

(52) U.S. Cl.

CPC ..... *E01H 5/045* (2013.01); *E01H 5/09* (2013.01); *E01H 5/12* (2013.01)

(58) Field of Classification Search

CPC ..... B30B 11/24; E01C 19/4893; E01F 7/02; E01H 5/00; E01H 5/096; E01H 5/09; E01H 5/097; E01H 5/045; E01H 5/076; E01H 5/061; E01H 5/106; E01H 5/098; E01H 5/04; E01H 5/12

USPC ..... 37/223–230, 239, 249, 250, 257, 260; 198/522, 570, 625

See application file for complete search history.

(56) References Cited

U.S. PATENT DOCUMENTS

| | | | |
|---|---|---|---|
| 684,052 | A | 10/1901 | Farquhar |
| 1,252,164 | A | 1/1918 | Peltier |
| 1,508,716 | A | 9/1924 | Ochs |

(Continued)

FOREIGN PATENT DOCUMENTS

| | | |
|---|---|---|
| CA | 454349 | 1/1949 |
| DE | 4022390 | 4/1992 |

(Continued)

*Primary Examiner* — Robert Pezzuto

(74) *Attorney, Agent, or Firm* — Lumen Patent Firm

(57) ABSTRACT

A snow compression and removal device is provided that includes a horizontal auger supported within a concave snow plow, a pump having an input disposed at a first end of the auger and an opening at a second end, a compression module first end disposed at an output of the pump, where the compression module includes a tubular casing having a snow inlet and a snow outlet, where the snow outlet has a converging or straight cross-section tubular shape that is perforated with air holes, and a conveyor screw, where the conveyor screw rotates on an axis that is disposed concentric to the tubular casing and spans from the snow inlet to the outlet and is powered to move and compact snow from the inlet to the outlet, where air from the snow is exhausted through the air holes, where the compressed snow is output.

16 Claims, 5 Drawing Sheets

(56) References Cited

U.S. PATENT DOCUMENTS

| | | | | |
|---|---|---|---|---|
| 2,642,679 | A | 6/1953 | Zamboni | |
| 2,642,680 | A * | 6/1953 | Curtis | E01H 5/04 193/16 |
| 2,936,537 | A | 5/1960 | Bain | |
| 3,622,205 | A | 11/1971 | Zamboni | |
| 4,312,143 | A * | 1/1982 | Kado | E01H 5/045 37/261 |
| 4,393,537 | A | 7/1983 | Reprogle | |
| 4,443,958 | A | 4/1984 | Huotari | |
| 4,651,452 | A | 3/1987 | Husso | |
| 5,951,782 | A | 9/1999 | Truitt | |
| 6,931,771 | B1 * | 8/2005 | Liebl | E01H 5/045 37/248 |

FOREIGN PATENT DOCUMENTS

| | | |
|---|---|---|
| DE | 29502694 | 6/1995 |
| DE | 29719508 | 2/1998 |
| DE | 20106150 | 7/2001 |
| EP | 0197259 | 10/1986 |
| EP | 0197258 | 10/1989 |
| EP | 0296563 | 2/1992 |
| EP | 0727527 | 8/1996 |
| EP | 0769589 | 4/1997 |
| FR | 2040831 | 1/1971 |
| FR | 2116956 | 7/1972 |
| FR | 2652103 | 3/1991 |
| FR | 2901290 | 11/2007 |
| GB | 1228730 | 4/1971 |
| WO | WO2010/105760 | 9/2010 |

* cited by examiner

SNOW REMOVAL DEVICE

CROSS-REFERENCE TO RELATED APPLICATIONS

This application claims priority from U.S. Provisional Patent Application 62/047,952 filed Sep. 9, 2014, which is incorporated herein by reference. This application claims priority from U.S. Provisional Patent Application 62/114,144 filed Feb. 10, 2015, which is incorporated herein by reference. This application is a continuation-in-part of U.S. patent application Ser. No. 14/391,167 filed Oct. 8, 2014, which is incorporated herein by reference. U.S. patent application Ser. No. 14/391,167 filed Oct. 8, 2014 is a 371 of PCT Patent Application EP2013/057325 filed Apr. 8, 2013, which is incorporated herein by reference. PCT Patent Application EP2013/057325 filed Apr. 8, 2013 claims priority from U.S. Provisional Patent Application 61/623,918 filed Apr. 13, 2012, which is incorporated herein by reference.

FIELD OF THE INVENTION

The present invention relates generally to snow removal. More particularly, the invention relates to a snow removal system that can be mounted on heavy-duty vehicles, such as tractors and loaders.

BACKGROUND OF THE INVENTION

Airport snow removal and storage is an important issue that impacts safety, schedules and cost. What is needed is a device for snow removal that efficiently and affordably clears airports from snow.

SUMMARY OF THE INVENTION

To address the needs in the art, a snow compression and removal device is provided that includes a concave snow plow, a horizontal auger supported within the concave snow plow, a pump, where an input of the pump is disposed at a first end of the horizontal auger, where an opening is disposed at a second end of the horizontal auger, a compression module, where a first end of the compression module is disposed at an output of the pump, where the compression module includes a tubular casing, where the tubular casing has a snow inlet at a first end and a snow outlet at a second end, where the snow outlet has a converging or straight cross-section tubular shape, where the tubular casing is perforated with air holes, and a conveyor screw, where the conveyor screw rotates on an axis that is disposed concentric to the tubular casing, where the conveyor screw spans from the snow inlet to the snow outlet, where the conveyor screw is powered to move snow from the snow inlet to the snow outlet and compacts the snow to a compressed state at the snow outlet, where air from the snow is exhausted through the air holes, where the compressed snow is output from the snow outlet.

According to one aspect, the invention further includes at least one flexible flap, where the at least one flexible flap is disposed on a bottom surface of the concave snow plow, where the at least one flexible flap is disposed to clean a plowing surface of snow that is proximal to the plowing surface.

According to another aspect of the invention, a height of the pump outlet is equal to a peak-to-peak pitch length of the conveyor screw, where a width of the pump outlet is equal to an outer radius of the conveyor screw at the tubular casing inlet minus a radius of a shaft of the conveyor screw.

In a further aspect of the invention, the snow outlet of the tubular casing includes a cylinder shape having a sidewall opening, where the snow outlet of the tubular casing includes a snow outlet conveyor screw, where the snow outlet conveyor screw has a helical screw coil that is in a direction opposite to a direction of rotation of the conveyor screw, where the snow outlet conveyor screw helical coil has a fixed-pitch. In one aspect, a height of the sidewall opening is equal to a peak-to-peak pitch length of the conveyor screw, where a width of the sidewall opening is equal to an outer radius at the outlet of the vertical auger minus a radius of a shaft of the conveyor screw.

In another aspect, the invention further includes a gutter, where the gutter is connected to the snow outlet, where the gutter is stationary or rotatable.

In yet another aspect of the invention, the conveyor screw shaft includes a hollow shaft that is perforated with air holes, where air from the snow is exhausted through the air holes.

According to one aspect of the invention, the conveyor screw shaft has a diverging shaft cross-section along the snow outlet.

In a further aspect of the invention, the conveyor screw has a constant screw pitch or a decreasing screw pitch.

DETAILED DESCRIPTION

The invention relates to snow removal machines that can be mounted on heavy-duty vehicles, such as tractors and loaders. According to one embodiment, an invented snow removal device is provided that includes a horizontal rotatable cylindrical conveyor screw (hereinafter referred to as conveyor screw) arranged for scraping, collecting and transporting snow from a surface. In a further embodiment, additional measures are preferably arranged behind the conveyor screw for further improving the device in clearing of the surface, while keeping the surface intact as much as possible.

One embodiment of the current invention combines at least three processes in one device: 1) scraping, collecting and transporting snow from a surface to the side (same function as a plough) with the conveyor screw and a wedge, preferably positioned perpendicular to the direction of movement 2) the cleaning of the surface with a wedge and a rotatable cylindrical brush, preferably parallel positioned to the screw and 3) the loading of the collected snow of processes 1) and 2) with an elevated (substantially vertical positioned) rotatable cylindrical conveyor screw, which includes a movable outlet to load the snow in bulk mass moving equipment such as trucks. The elevated screw of process may include a snow compressing part.

Figure 1A:
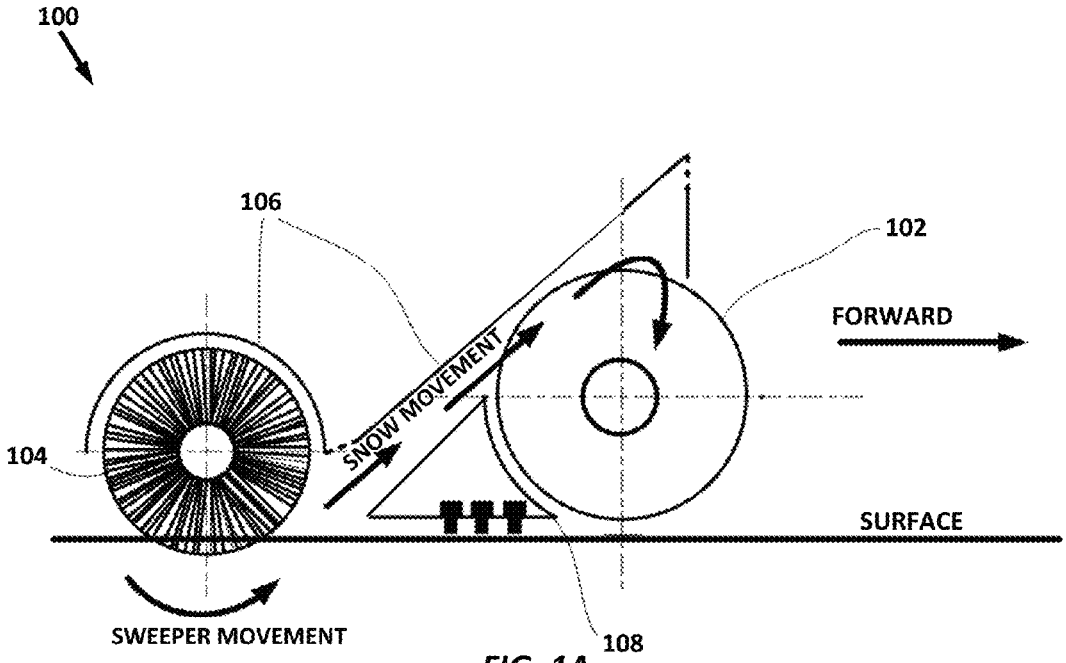
FIGS. 1A-1C show cutaway views of the snow removal device, according to one embodiment of the invention.
Figure 1B:
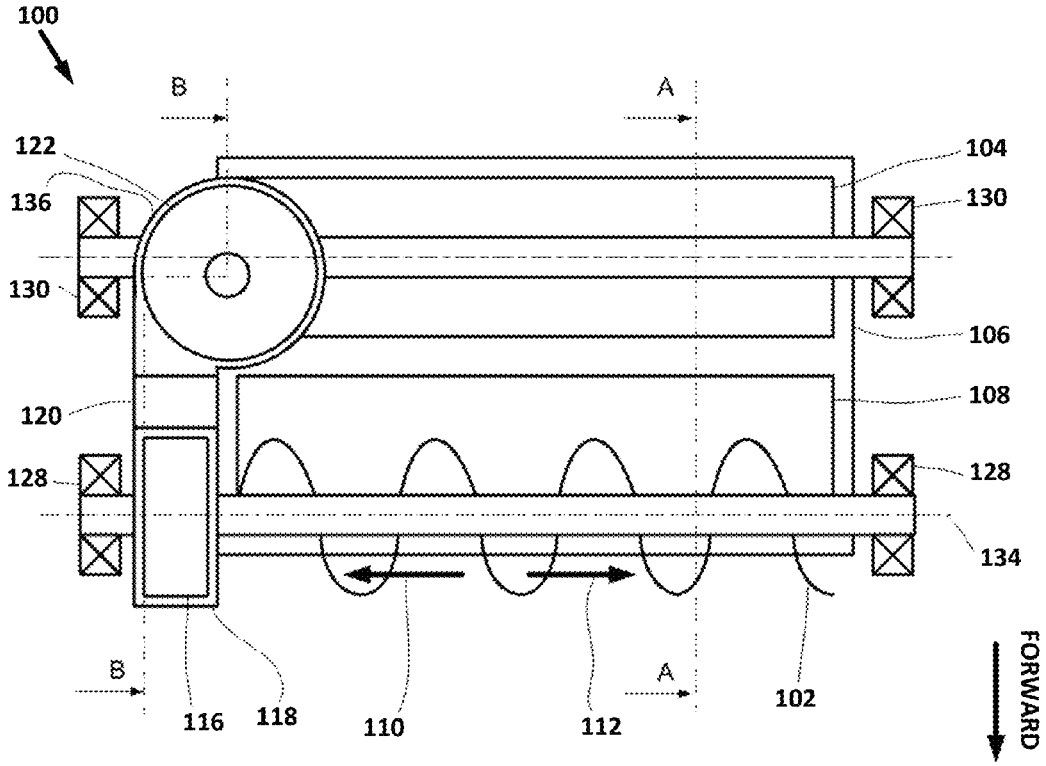
Figure 4:
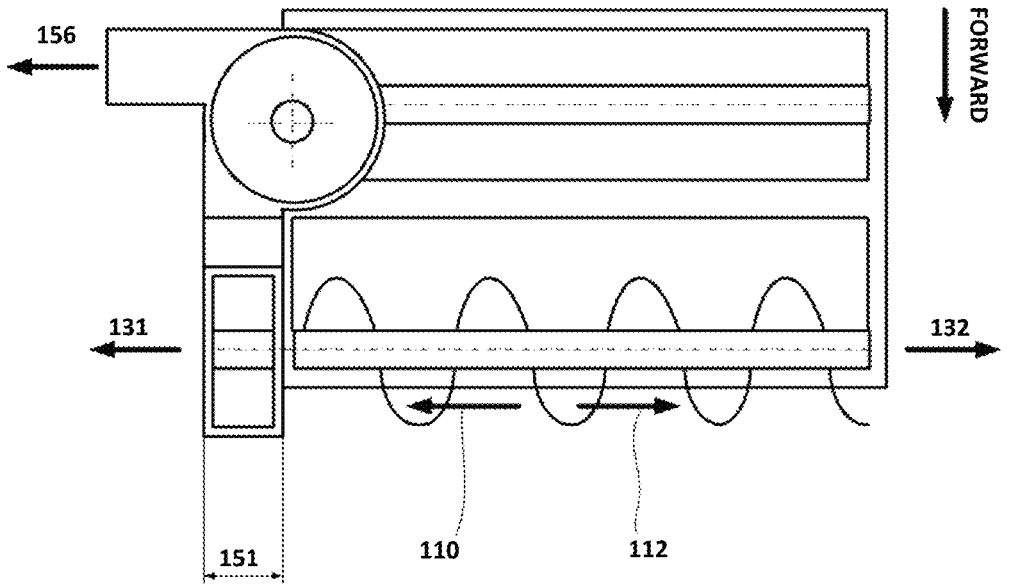
FIG. 4 shows a top cutaway view of the snow removal device, according to one embodiment of the invention.

FIG. 1A is a cross sectional view according to line AA of FIG. 1B, which show a snow removal apparatus 100, according to one embodiment of the invention. As shown, a construction driven in the forward direction over a surface is provided that includes a cylindrical rotating conveyor screw 102, a cylindrical rotating brush 104, a casing 106, where the casing 106 is capable of limiting the upper side of the flow of snow from the brush 104 and the conveyor screw 102. The current embodiment further includes a wedge 108 that is capable of limiting the lower side of the flow of snow from the brush 104 and the conveyor screw 102. According to the current embodiment, all of the shafts shown in the figures may be driven using actuators, such as hydraulic actuators. Further, all degrees of freedom of the invention (including the construction) may be unpowered or powered by actuators, such as hydraulic actuators. By moving in the forward direction, the snow will encounter the conveyor screw 102 first. By the movement of the conveyor screw 102 in one direction, the snow will flow in direction 110 (see FIG. 1B). The outlet of this operational mode is through the gutter 156 of FIG. 4 or directly on the side 131 of FIG. 4. Further shown in FIG. 1B is an impeller 116 supported by casing 118, where the impeller 116 transfers snow through duct 120 to elevated conveyor screw 122. The reverse direction of the conveyor screw 102 will result in a direction 112 of the flow of snow with a resulting flow out of the conveyor screw 132 shown in FIG. 4.

Figure 1C:
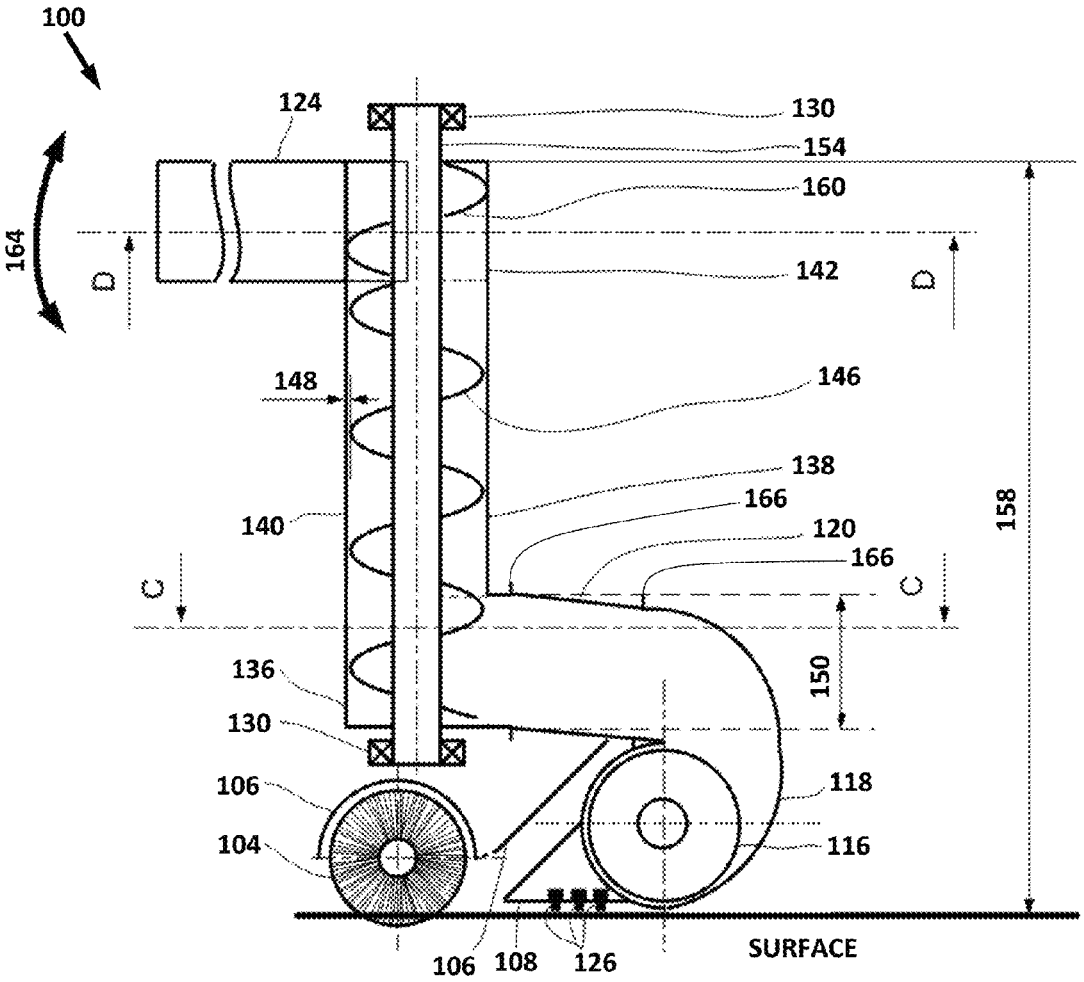

Turning now to FIG. 1C, in this operation mode the impeller 116, elevated conveyor screw 122 and the gutter 124 are superfluous. The remaining layer of snow will pass under the wedge 108 and flexible flaps 126 to the brush 104. These last remainders will be ejected by the movement of the brush 104 and guided by the upper 106 casing and wedge 108 towards the upper part of the conveyor screw 102 where these last remainders are deposited on the moving snow mass in the conveyor screw 102. In FIG. 1A, this flow of snow is indicated by the arrows. An addition to the lower casing are flexible flaps 126. These flexible flaps 126 push the majority of remainders after the conveyor screw 102 forward, in order to minimize the remaining snow for the brush 108. There may be one or multiple of these flexible flaps 126 as is indicated in FIG. 2.

Figures 5A, 5B, 5C:
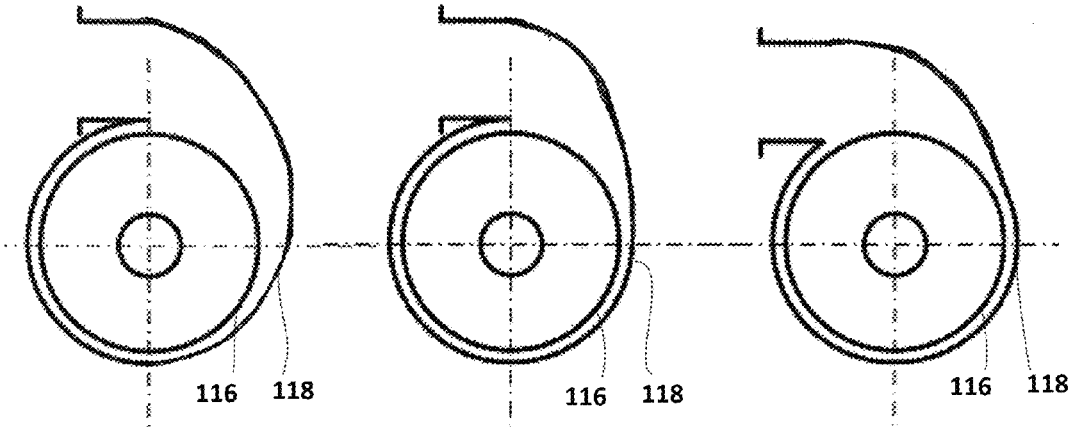
FIGS. 5A-5C show a side cutaway view of the impeller in the casing, where the casing has different shapes, according to one embodiment of the invention.

FIG. 1B is a cross sectional view according line CC of FIG. 1C. The snow in the conveyor screw 102 (suspended in a not drawn construction with bearings 128), including the snow from the brush 104 (suspended in a not drawn construction with bearings 130), is transported towards the impeller 116. But may also be transported towards the other side 112 by changing the rotation of the conveyor screw 102. The impeller 116 is rotating in a casing 118 that prevents further axial snow movement from the conveyor screw 102, except during the operation of with snow output 131. This housing may have different shapes like illustrated in FIGS. 5A-5C. The impeller 116 rotates preferably around the same centerline 134 as the horizontal conveyor screw 102, but may turn at the same or different speeds and in opposite direction. The impeller 116 presses the snow through a duct 120 in a non-rotating housing inlet 136, which is part of housing 138.

FIG. 1C is a cross sectional view according line BB of FIG. 1B. Housing 138 of the elevated conveyor screw having the non-rotating inlet 136, non-rotating cylindrical middle section 140 and rotating outlet 142 in degree of freedom 144. Inlet 136 and outlet 142 preferably have the shape of a snail-shell, like casing 118 of the impeller 116. In housing 138 the elevated conveyor screw 146 is rotating, which is suspended by bearings 130. The preferred distance 148 between the outer radius of the elevated conveyor screw 146 and the inner radius of the non-rotating housing 138 is preferably between 0.5 millimeter and 5 millimeter. The preferred width 151 of the duct 120 equals the outer radius of the elevated conveyor screw 146 casing minus the radius of the shaft 154 of the elevated conveyor screw 146. According to one embodiment, the preferred height 150 of the duct 120 substantially equals the pitch height of the elevated conveyor screw 146. The impeller 116, housing of the impeller 118, duct 120 and elevated conveyor screw 146 may be placed at the other side of the horizontal conveyor screw 102 outlet. By describing the drawn version this possibility is not excluded from the invention. In a further embodiment, the part of the casing 118 of the impeller 116 that prevents the axial flow of snow in the direction 110, results in an outlet for snow direction 131 may be removed.

Figure 2:
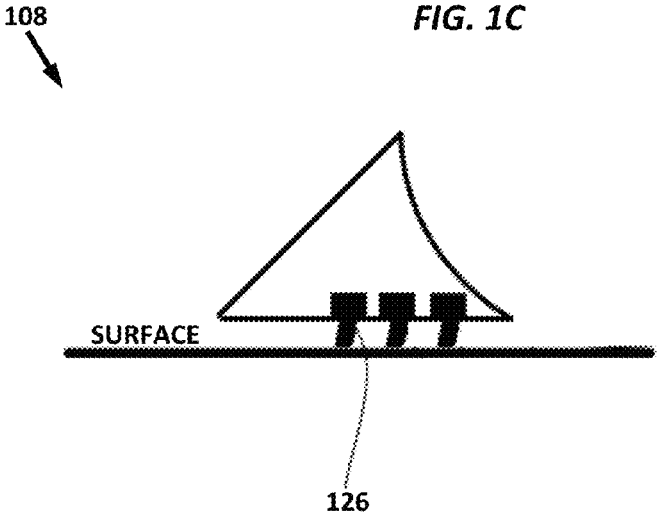
FIG. 2 shows a wedge and flexible flaps to the brush the plowing surface, according to one embodiment of the invention.

In FIG. 2 the wedge 108 and the flexible flaps 126 are illustrated in more detail. These components have at least two functions. It pushes the snow upwards from the surface and forces the snow to remain in the conveyor screw 102, which forces a side movement 110 or 112 on the snow. The flexible flaps 126 scrape the surface, to minimize the remainders of snow and other potential debris for the brush 104.

Figure 3:
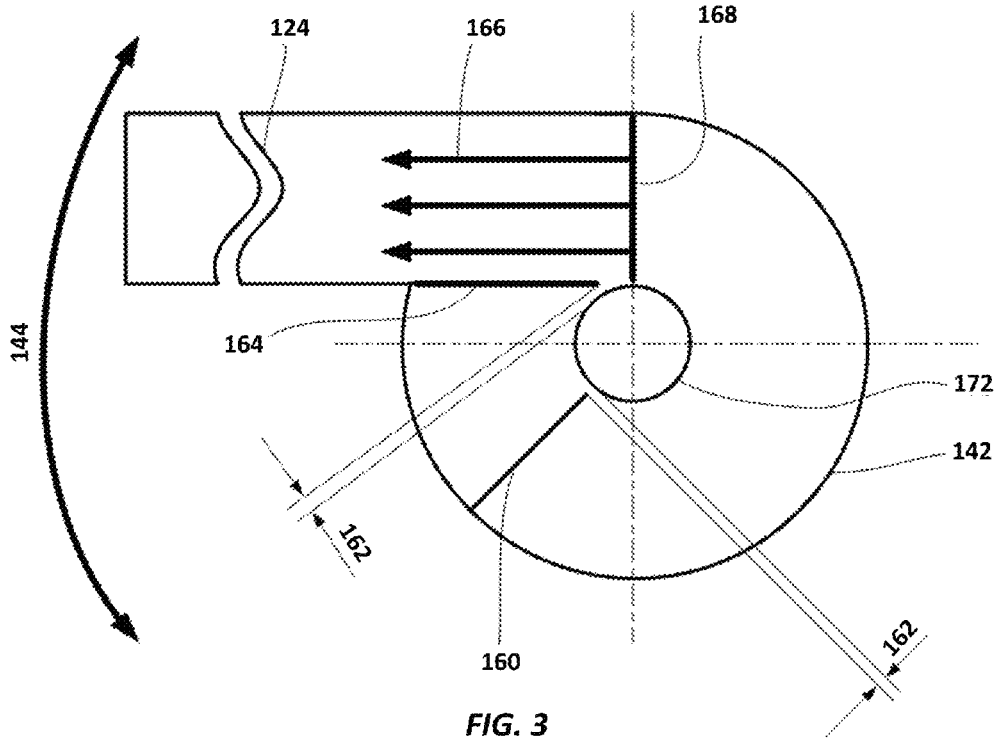
FIG. 3 shows a top cutaway view of the rotating outlet, according to one embodiment of the invention.

FIG. 3 is a cross sectional view according line DD of FIG. 1C. In FIG. 1C the top of the non-rotating housing inlet 136 has a height 158 to allow a desirable operation, such as the loading of the snow from the inventive device in a truck or a container on a truck. In FIG. 1C, the outlet of the elevated conveyor screw 160 has a fixed pitch, with a scraping device 164 in a housing 142 that can rotate preferably 360 degrees in direction 144 around the centerline of the elevated conveyor screw 146. The direction of the pitch of conveyor screw 160 is in opposite direction of the pitch of the elevated conveyor screw 146. The scraping device 164 is part of a movable gutter 124 that forces a tangential movement of the snow indicated by arrows 166 at line 168 into the gutter 124. Preferably the distance 162 between the scraping device 164, conveyor screw 160 and the shaft 172 of the elevated conveyor screw 146 is between 0.5 and 5 millimeter, according to one embodiment of the invention. The gutter 124 may be steered in directions 144 and/or 164 by the operator of the heavy-duty vehicle to load the snow in, for example a truck. The length of this gutter may be varied in dependence of the application.

Embodiments of the invention pertain to duct 124 to transport or guide snow. The circumference of the duct 124 can be open or closed and guides the snow from an inlet to an outlet. The shape of the inlet, outlet and the circumference along the length of the duct can be cylindrical, square, rectangular, triangular, elliptical, or any other shape. The duct can be straight, conical and or bended in a curvature.

Embodiments of this invention enable snow transport through the duct 120 when the temperature of the duct 120 is below zero degrees Celsius and the snow has a liquid water content and enables snow transport when the temperature of the duct 120 is above zero degrees Celsius due to heating.

Figure 6:
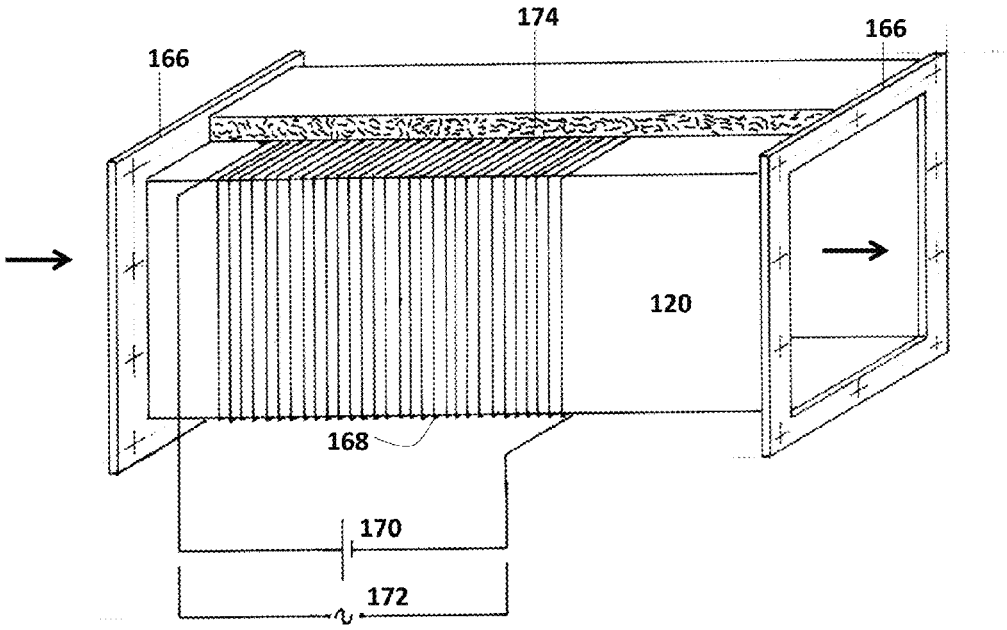
FIG. 6 shows a heated snow duct for transporting snow under freezing conditions, according to one embodiment of the invention.

In FIG. 6 a rectangular duct 120 with flanges 166 is shown. The duct may have other shapes. The transport direction of the snow is shown with the arrows, however the invention also is applicable to a reversed flow. Embodiments of the invention have a duct with an external heating to ensure a temperature of the inner wall of the duct above zero degrees Celsius. In this case, in FIG. 1, an electrical heating 168 is shown. The electrical heating power can either be supplied by direct current 170 or alternating current 172. The external heating can also be supplied by any other process or medium, like a burner or hydraulic oil. The heater and the duct can or cannot be thermally insulated 174. The thermal insulation in FIG. 6 is only partially shown.

The temperature of the inner wall of the duct can be controlled but does not have to be controlled. The heat can be supplied partially or entirely over the length of the duct and the heat can be supplied partially or entirely over the circumference of the duct.

Figure 7:
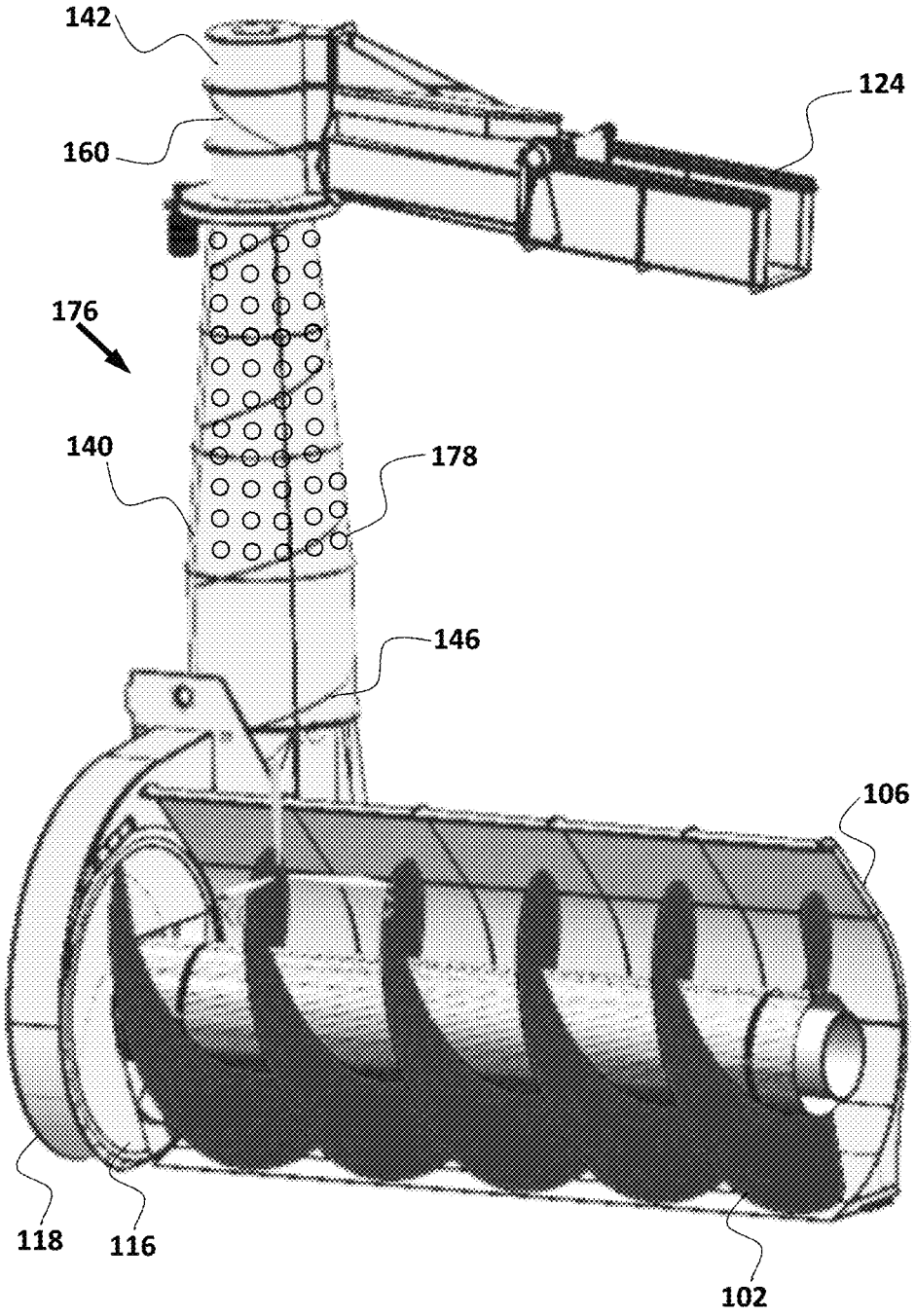
FIG. 7 shows a perspective view of a snow compression and removal device, according to one embodiment of the invention.

In a further embodiment, FIG. 7 show a snow compression and removal device having a casing 106 formed as a concave snow plow, a cylindrical rotating conveyor screw 102 supported within the concave snow plow, an impeller 116 supported by casing 118 that operate as a pump, where an input of the pump is disposed at a first end of the horizontal auger, where an opening is disposed at a second end of the conveyor screw 102, a compression module 176, where a first end of the compression module 176 is disposed at an output of the pump, where the compression module 176 includes a tubular casing 140, where the tubular casing has a snow inlet at a first end and a snow outlet at a second end, where the snow outlet has a converging or straight cross-section tubular shape, where the tubular casing is perforated with air holes 178, and a conveyor screw 146, where the conveyor screw rotates on an axis that is disposed concentric to the tubular casing 140, where the conveyor screw 146 spans from the snow inlet to the snow outlet, where the conveyor screw 146 is powered to move snow from the snow inlet to the snow outlet and compacts the snow to a compressed state at the snow outlet, where air from the snow is exhausted through the air holes 178, where the compressed snow is output from the snow outlet.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example variations to clear parking lots, ports, municipalities and variations to load snow melters.

All such variations are considered to be within the scope and spirit of the present invention as defined by the following claims and their legal equivalents.

What is claimed:

1. A snow compression and removal device, comprising:

a. a concave snow plow;

b. a horizontal auger supported within said concave snow plow;

c. a pump, wherein an input of said pump is disposed at a first end of said horizontal auger, wherein an opening is disposed at a second end of said horizontal auger;

d. a compression module, wherein a first end of said compression module is disposed at an output of said pump, wherein said compression module comprises:

i. a tubular casing, wherein said tubular casing comprises a snow inlet at a first end and a snow outlet at a second end, wherein said snow outlet comprises a converging or straight cross-section tubular shape, wherein said tubular casing is perforated with air holes; and ii. a conveyor screw, wherein said conveyor screw rotates on an axis that is disposed concentric to said tubular casing, wherein said conveyor screw spans from said snow inlet to said snow outlet, wherein said conveyor screw is powered to move snow from said snow inlet to said snow outlet and compacts said snow to a compressed state at said snow outlet, wherein air from said snow is exhausted through said air holes, wherein said compressed snow is output from said snow outlet.

2. The snow compression and removal device of claim 1 further comprises at least one flexible flap, wherein said at least one flexible flap is disposed on a bottom surface of said concave snow plow, wherein said at least one flexible flap is disposed to clean a plowing surface of snow that is proximal to said plowing surface.

3. The snow compression and removal device of claim 1, wherein a height of said pump outlet is equal to a peak-to-peak pitch length of said conveyor screw, wherein a width of said pump outlet is equal to an outer radius of said conveyor screw at said tubular casing inlet minus a radius of a shaft of said conveyor screw.

4. The snow compression and removal device of claim 1, wherein said snow outlet of said tubular casing comprises a cylinder shape having a sidewall opening, wherein said snow outlet of said tubular casing comprises a snow outlet conveyor screw, wherein said snow outlet conveyor screw comprises a helical screw coil that is in a direction opposite to a direction of rotation of said conveyor screw, wherein said snow outlet conveyor screw helical coil comprises a fixed-pitch.

5. The opening of claim 4, wherein a height of said sidewall opening is equal to a peak-to-peak pitch length of said conveyor screw, wherein a width of said sidewall opening is equal to an outer radius at the outlet of the vertical auger minus a radius of a shaft of said conveyor screw.

6. The snow compression and removal device of claim 1 further comprises a gutter, wherein said gutter is connected to said snow outlet, wherein said gutter is stationary or rotatable.

7. The snow removal system of claim 1, wherein said conveyor screw shaft comprises a hollow shaft that is perforated with air holes, wherein air from said snow is exhausted through said air holes.

8. The snow removal system of claim 1, wherein said conveyor screw shaft comprises a diverging shaft cross-section along said snow outlet.

9. The snow removal system of claim 1, wherein said conveyor screw comprise a constant screw pitch or a decreasing screw pitch.

10. A snow compression and removal device, comprising:

a. a concave snow plow;

b. a horizontal auger supported within said concave snow plow;

c. a pump, wherein an input of said pump is disposed at a first end of said horizontal auger, wherein an opening is disposed at a second end of said horizontal auger;

d. a compression module, wherein a first end of said compression module is disposed at an output of said pump, wherein said compression module comprises:

i. a tubular casing, wherein said tubular casing comprises a snow inlet at a first end and a snow outlet at a second end, wherein said snow outlet comprises a tubular shape; and ii. a conveyor screw, wherein said conveyor screw rotates on an axis that is disposed concentric to said tubular casing, wherein said conveyor screw spans from said snow inlet to said snow outlet, wherein said conveyor screw is powered to move snow from said snow inlet to said snow outlet and compacts said snow to a compressed state at said snow outlet, wherein said compressed snow is output from said snow outlet.

11. The snow compression and removal device of claim 10 further comprises at least one flexible flap, wherein said at least one flexible flap is disposed on a bottom surface of said concave snow plow, wherein said at least one flexible flap is disposed to clean a plowing surface of snow that is proximal to said plowing surface.

12. The snow compression and removal device of claim 10, wherein a height of said pump outlet is equal to a peak-to-peak pitch length of said conveyor screw, wherein a width of said pump outlet is equal to an outer radius of said conveyor screw at said tubular casing inlet minus a radius of a shaft of said conveyor screw.

13. The snow compression and removal device of claim 10, wherein said snow outlet of said tubular casing comprises a cylinder shape having a sidewall opening, wherein said snow outlet of said tubular casing comprises a snow outlet conveyor screw, wherein said snow outlet conveyor screw comprises a helical screw coil that is in a direction opposite to a direction of rotation of said conveyor screw, wherein said snow outlet conveyor screw helical coil comprises a fixed-pitch.

14. The opening of claim 13, wherein a height of said sidewall opening is equal to a peak-to-peak pitch length of said conveyor screw, wherein a width of said sidewall opening is equal to an outer radius at the outlet of the vertical auger minus a radius of a shaft of said conveyor screw.

15. The snow compression and removal device of claim 10 further comprises a gutter, wherein said gutter is connected to said snow outlet, wherein said gutter is stationary or rotatable.

16. A snow compression and removal device, comprising:

a. a concave snow plow;

b. a horizontal auger supported within said concave snow plow;

c. a pump, wherein an input of said pump is disposed at a first end of said horizontal auger, wherein an opening is disposed at a second end of said horizontal auger;

d. a compression module, wherein a first end of said compression module is disposed at an output of said pump, wherein said compression module comprises:

i. a tubular casing, wherein said tubular casing comprises a snow inlet at a first end and a snow outlet at a second end, wherein said snow outlet comprises a tubular shape;

ii. a conveyor screw, wherein said conveyor screw rotates on an axis that is disposed concentric to said tubular casing, wherein said conveyor screw spans from said snow inlet to said snow outlet, wherein said conveyor screw is powered to move snow from said snow inlet to said snow outlet and compacts said snow to a compressed state at said snow outlet, wherein said compressed snow is output from said snow outlet; and iii. at least one flexible flap configured to scrap a plowing surface.

* * * * *